US012709450B2

(12) United States Patent
Pryor

(10) Patent No.: US 12,709,450 B2
(45) Date of Patent: Aug. 18, 2026

(54) MINIMAL PACKAGING CAN MULTIPACK SYSTEM

(71) Applicant: THAI UNION GROUP PUBLIC COMPANY LIMITED, Samutsakorn (TH)

(72) Inventor: James Garfield Pryor, High Wycombe (GB)

(73) Assignee: THAI UNION GROUP PUBLIC COMPANY LIMITED, Samutsakorn (TH)

( * ) Notice: Subject to any disclaimer, the term of this patent is extended or adjusted under 35 U.S.C. 154(b) by 6 days.

(21) Appl. No.: 18/836,257

(22) PCT Filed: Jan. 19, 2023

(86) PCT No.: PCT/IB2023/050463
§ 371 (c)(1),
(2) Date: Aug. 6, 2024

(87) PCT Pub. No.: WO2023/152577
PCT Pub. Date: Aug. 17, 2023

(65) Prior Publication Data

US 2025/0153913 A1 May 15, 2025

(30) Foreign Application Priority Data

Feb. 9, 2022 (AU) ..... 2022900257

(51) Int. Cl.
*B65D 71/00* (2006.01)
*B65B 11/00* (2006.01)

(52) U.S. Cl.
CPC ..... *B65D 71/0085* (2013.01); *B65B 11/004* (2013.01)

(58) Field of Classification Search
CPC ..... B65D 71/0085; B65B 11/004
(Continued)

(56) References Cited

U.S. PATENT DOCUMENTS 4,210,684 A * 7/1980 Shriver ..... B05C 1/022 118/232
4,491,473 A * 1/1985 Bowman ..... C22B 21/0092 209/11
(Continued)

FOREIGN PATENT DOCUMENTS

CN 212499207 U 2/2021
EP 0 757 958 A1 12/1997
(Continued)

*Primary Examiner* — Jacob K Ackun
(74) *Attorney, Agent, or Firm* — Seed Intellectual Property Law Group LLP

(57) ABSTRACT

The present disclosure relates to an aluminum band for covering or wrapping at least partially a stack of substantially identical cans, said aluminum band being a composite strip comprising separation means intended to be positioned on a contact area of two adjacent cans of said stack, characterized in that, said separation means are torsion cutting means comprising at least two lines of notches separated from another by a separation portion intended to cover said contact area, and two lateral sides having a shape similar to V, U, or alike, and in that said aluminum band comprises an inner adhesive layer and an outer metal layer of aluminum or aluminum alloy foil.

17 Claims, 4 Drawing Sheets

(58) Field of Classification Search
USPC ..... 206/813, 460, 223, 459.5
See application file for complete search history.

(56) References Cited

U.S. PATENT DOCUMENTS

| | | | | |
|---|---|---|---|---|
| 4,778,210 | A * | 10/1988 | Paulson | B65D 67/02 206/427 |
| 7,458,458 | B2 | 12/2008 | Marco | |
| 2015/0021215 | A1* | 1/2015 | Clark | B65D 23/085 206/223 |
| 2020/0002042 | A1 | 1/2020 | Christman et al. | |

FOREIGN PATENT DOCUMENTS

| | | | |
|---|---|---|---|
| JP | 2004-083075 | A | 3/2004 |
| JP | 4498556 | B2 | 7/2010 |
| KR | 10-2010-0065441 | A | 6/2010 |
| KR | 10-2324128 | B1 | 11/2021 |

* cited by examiner

[Fig. 1]
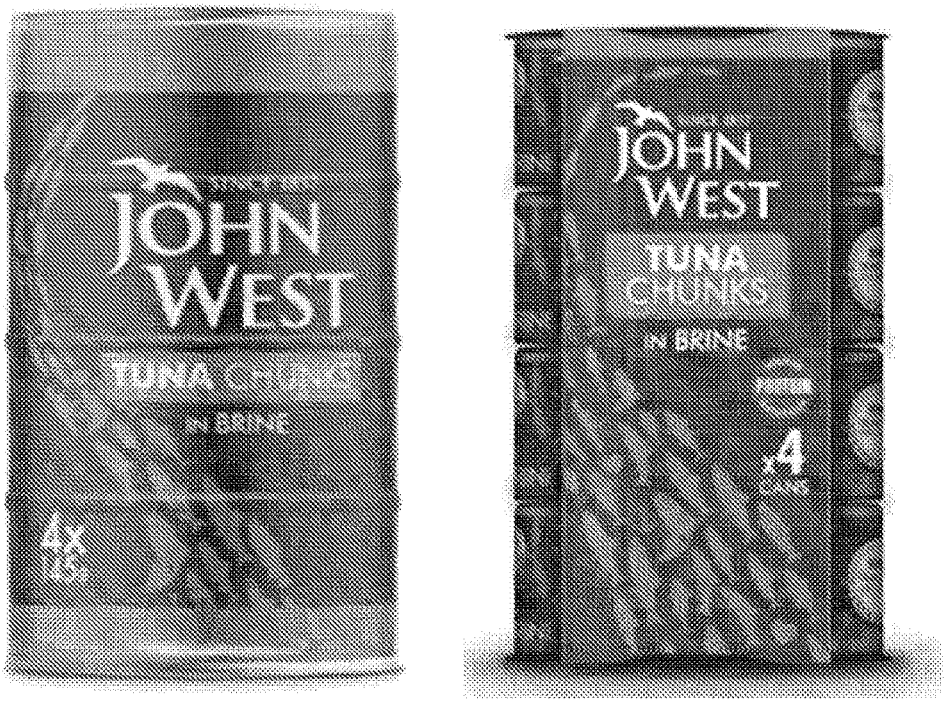
*Prior Art*
[Fig. 2]
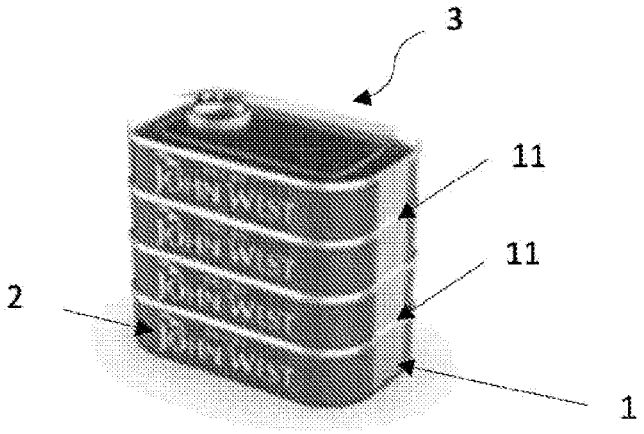

[Fig. 3]
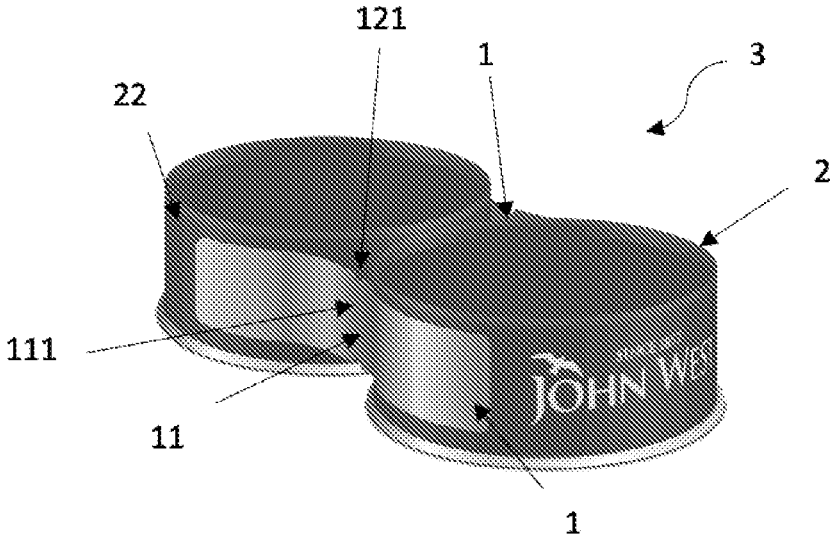
[Fig. 4]
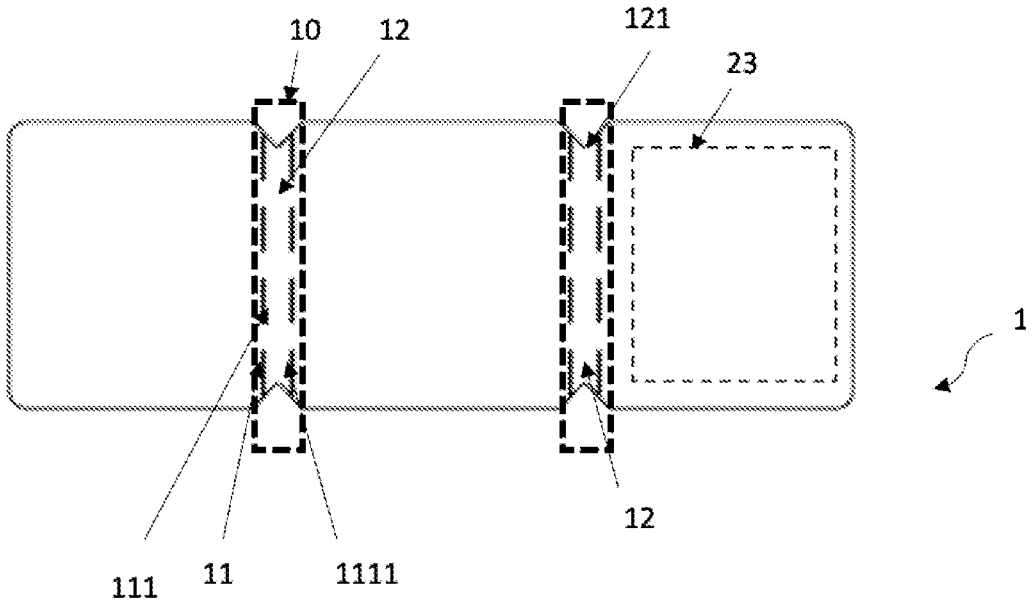

[Fig. 5]
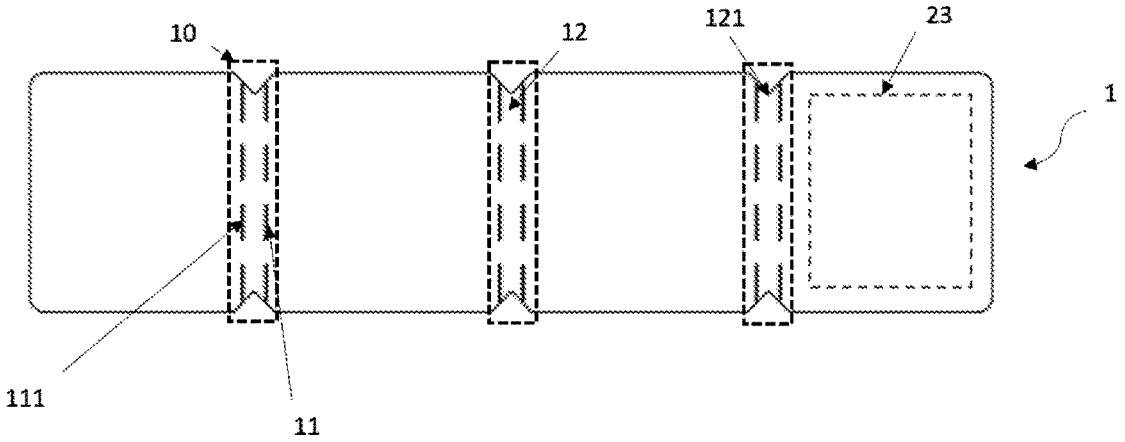
[Fig. 6]
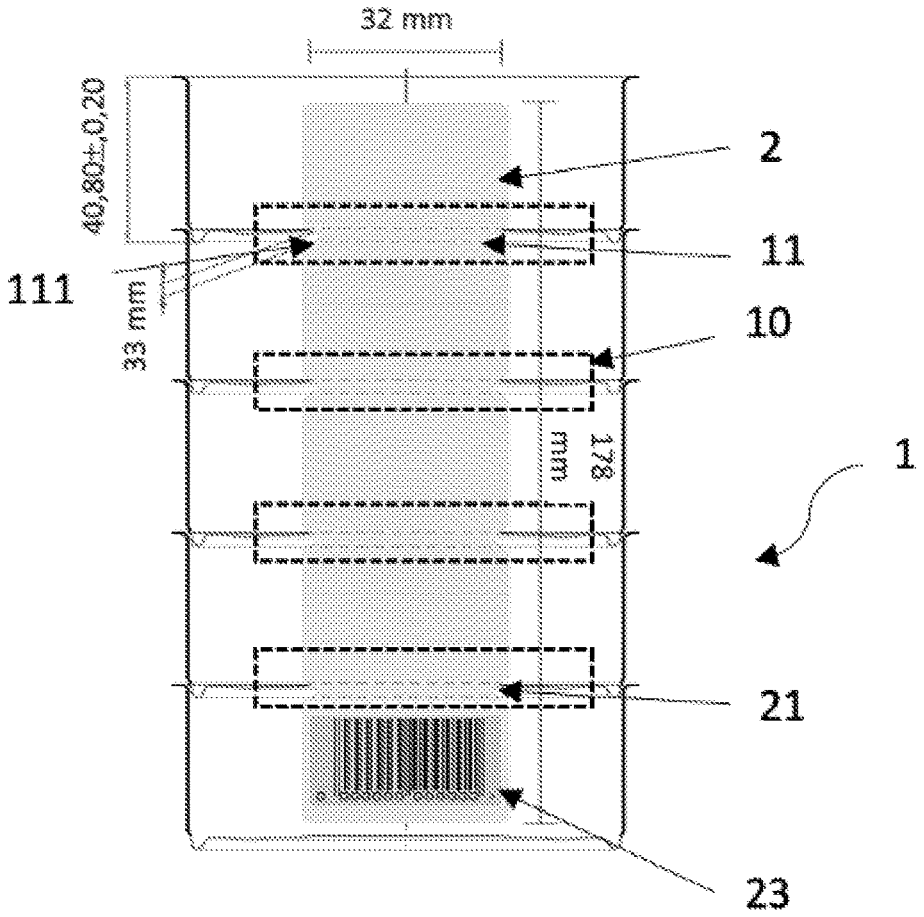

[Fig. 7]
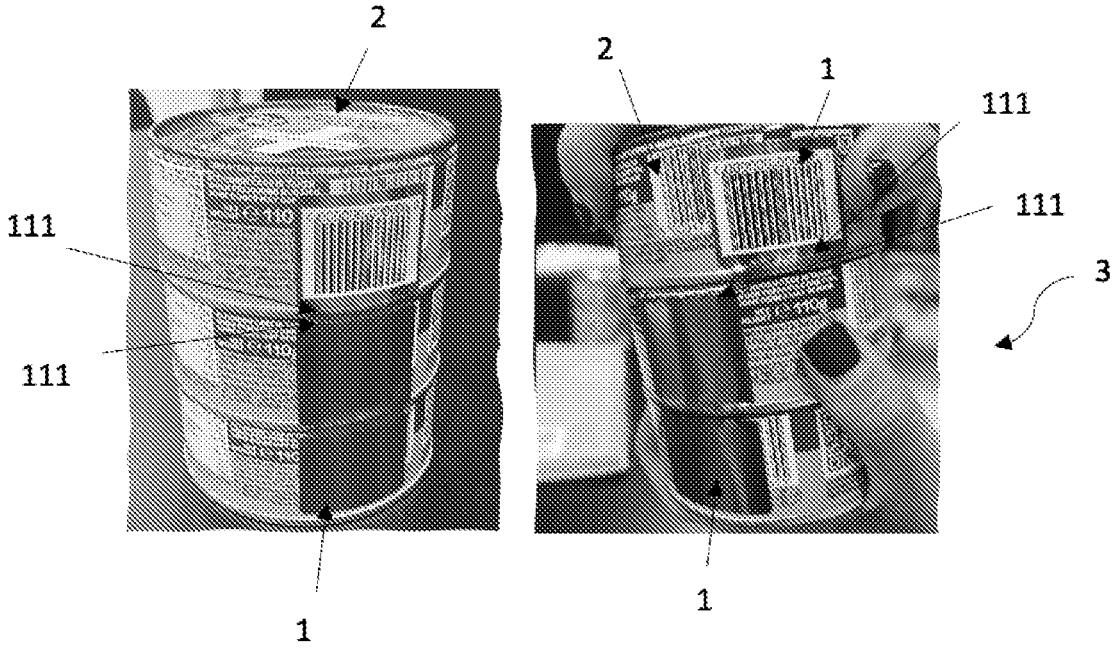

MINIMAL PACKAGING CAN MULTIPACK SYSTEM

CROSS-REFERENCE TO RELATED APPLICATIONS

This application claims the benefit of and priority to International Patent Application No. PCT/IB2023/050463 filed on Jan. 19, 2023 and Australian Patent Application No. 2022900257 filed on Feb. 9, 2022, both of which are incorporated herein by reference in their entirety.

BACKGROUND

Technical Field

The field of the disclosure is that of the minimal packaging can multipack systems.

More precisely, the disclosure concerns the improvement of a packaging can multipack system.

Description of the Related Art

The can multipack format is a common way to collect and sell cans in a convenient format in many markets.

The current standard for assembling cans in a multi-pack format uses either a PET/PVC plastic shrink sleeve or a paper/cardboard sleeve substrate as shown in [FIG. 1].

Although plastic packaging can have many benefits, including durability, lightness and versatility, plastics also come at a cost to the environment and are very energy intensive to produce. There is a wide range of problems with plastic which are caused by mishandling, among other things. Plastic waste can last for centuries and the associated chemicals pollute the environment.

In addition to meeting strict sustainability commitments, several major retailers have pledged to reduce the amount of plastic in the supply chain by 50% by 2025. While some retailers have confirmed no plastic not recyclable in their field beyond 2023.

Some manufacturers have developed plastic sleeves for multipack systems, in particular with the aim of reducing, only in part, the use of plastic. These plastic sleeves and associated packs cannot be recycled together, creating a problem for consumers, and a requirement for separation into two recycling streams. Another negative aspect is the fact that the plastic sleeve is difficult to open and often requires a sharp object.

It has been imagined adhesive tapes allowing to maintain the different cans integral with each other, as illustrated in the patent application JP200483075A. Nevertheless, with such a system, the laminated band must be peeled off the can because they cannot be recycled together as one piece. Indeed, in this case, it is necessary to separate the can and the laminated band into two streams separate recycling.

Many suppliers and retailers are switching to cardboard to reduce the amount of plastic in the supply chain. Cardboard is perceived as more durable than plastic, but in reality, it is not a long-term sustainable solution to the problem because cardboard has several negative impacts on the environment. In particular, the main environmental impacts of cardboard are deforestation, its high-water intensity of the production process and the emission of methane during disposal. Cardboard can only be partially recycled because it is made up of fibers and they get weaker each time they are recycled. Unfortunately, paper can be recycled up to 5-6 times, but after that, recycled paper can no longer be used in the manufacture of standard cardboard.

In the same way, cardboard sleeves were imagined. The cardboard sleeve offers a lower environmental impact compared to the plastic sleeve. However, the cardboard sleeve is not as durable in handling and transport and therefore the cans usually fall during transport during the buyer's journey. Retailers are also experiencing higher levels of shelf spoilage due to the lack of strength of the cardboard solution to hold the cans together.

Additionally, once a box is removed from a cardboard or plastic sleeve, as shown in the U.S. Pat. No. 7,458,458B2, the remaining boxes become unstable, with no rigid outer shell to support the multipack. Also, once the first box has been removed, the sleeve is thrown away, because it no longer has a function and is considered superfluous, excess packaging.

Packaging is also known which facilitates the separation of a product from its pack. Patent KR102324128B1 describes laminated band paper for packaging grouped products with perforated lines for easy separation, allowing each product to be separated into individual units. The applicant has also imagined, for heavier products, the use of backing paper on the laminated band to increase holding strength, but may obstruct the separation of the individual unit.

Similarly, the patent JP4498556B2 describes a laminated band with cutting line and notch for individual pack separation. Nevertheless, this laminated band is not strong enough to bind together heavy weight metallic cans in one stack that can withstand transit.

BRIEF SUMMARY

The disclosure aims to overcome these drawbacks of the prior art, and to propose an improvement of a minimal packaging can multipack system, offering the possibility of recycling all the elements of the system.

Another object of the disclosure is to provide a packaging can multipack system in which each can having the capability of being easily twisted off the multipack, and once one or a plurality of cans is removed, the unused cans remain neatly stacked together, can still be moved and transported easily, and can withstand transit throwing into trolleys/shopping bags.

Another object of the disclosure is to provide a packaging can multipack system which has the ability to bind together heavy weight cans.

For this purpose, the disclosure proposes an aluminum band for covering or wrapping at least partially a stack of substantially identical cans, said aluminum band being a composite strip comprising separation means intended to be positioned on the contact areas of two adjacent cans of said stack.

According to the disclosure, said separation means are torsion cutting means comprising at least two lines of notches separated from another by a separation portion intended to cover said contact area, and two lateral sides having a shape similar to V, U or alike, and in that said laminated tape comprises an inner adhesive layer and an outer metal layer of aluminum or aluminum alloy foil.

By aluminum band, it is meant in the sense of the present application a composite in the form of a tape comprising an outer layer of aluminum.

In the present description, the wording "for covering partially" means that the aluminum band covers at least part of the surface of the pack of cans, and the wording "for wrapping partially" means that the aluminum band surrounds the whole pack, so as to tighten and hold the cans against each other.

Such lines of notches and lateral sides make it easy to detach one of the cans from the rest of the multipack, while the rest of the stack of cans remain neatly banded together. The lateral sides of the portion of separation, with V-shape or U-shape or alike, permit to reduce the rotational force and assist with the easy separation of the cans through the rotation action.

Thus, single or multiple cans can be separated and leave the remaining cans intact together for neat organization. The double lines of notches that have been cut into the aluminum band at the point where the cans meet allow the multipack system to bind heavy metal cans together.

Moreover, the aluminum composition of the band offers the possibility of recycling the entire can and band in the same recycling cycle.

According to a possible variant, said inner adhesive layer of the aluminum band is chosen among polymers, metals and paper.

According to a possible variant, said inner adhesive layer of the aluminum band is polyethylene, preferably polyethylene with low-density.

According to a possible variant, wherein the aluminum band comprises a 2 or 3 dimensional deep embossing tack label.

According to a possible variant, wherein said tack label comprises QR codes or EAN barcodes.

The disclosure also proposes a packaging can multipack system comprising an arrangement of cans and a least one aluminum band covering or wrapping at least partially said arrangement of cans.

According to a possible variant, said packaging can multipack system comprises one single aluminum band wrapping around all cans together being arranged either in a vertical or a horizontal stack.

According to a possible variant, said packaging can multipack system comprises a plurality of aluminum bands applied on either side of the stack of cans.

According to a possible variant, said packaging can multipack system comprises two aluminum bands applied on two opposite sides of a vertical stack of cans.

The disclosure also proposes a method for manufacturing a packaging can multipack system according to one of claims 6 to 8, including the following steps:

- alignment or superposition of a plurality of substantially identical cans so as to form a stack,
- application of a least on aluminum band on the stack, so that the separation portion is superimposed on the sidewall of the cans,
- application of pressure to the properly positioned aluminum band.

BRIEF DESCRIPTION OF THE SEVERAL VIEWS OF THE DRAWINGS

Other features and advantages of the disclosure will appear upon reading the following description of particular embodiments, given by way of simple illustrative and non-limiting example, and the appended drawings, among which:

FIG. 1 illustrates two examples of prior art multipack systems;

FIG. 2 illustrates in front perspective four cans superimposed and connected by two aluminum bands according to an embodiment of the disclosure;

FIG. 3 illustrates in front perspective two cans horizontally aligned and connected by an aluminum band according to another embodiment of the disclosure;

FIG. 4 schematically illustrates an aluminum band designed to covering three cans according to an embodiment of the disclosure;

FIG. 5 schematically illustrates an aluminum band designed to covering four cans according to the embodiment of FIG. 4;

FIG. 6 schematically illustrates five cans aligned and connected by an aluminum band according to the embodiment of FIG. 4;

FIG. 7 schematically illustrates three cans aligned and connected by an aluminum band according to the embodiment of FIG. 4, before and after separation of one of the cans.

DETAILED DESCRIPTION

Can Assembly

In the present description, the multipack system is intended to assemble a plurality of cans, that is to say at least two cans, by one or more aluminum bands. Cans are especially cans for transportation, storage and display of goods.

The cans can be arranged in different ways. They can be stacked, so as to form vertical stack in which the cans are superposed with respect to each other, as shown in FIG. 2. In this first embodiment, multipack system 3 includes a plurality of parallelepiped cans 2 which are aligned in the straight line and in which the horizontal sides of the cans 2 are in contact.

The multipack 3 also includes two lengthwise aluminum bands 1 which makes it possible to link all the cans together. It should be noted that only one aluminum band is visible, but that this embodiment preferably comprises two identical aluminum bands. The second aluminum band, not visible, is positioned at the level of the opposite face to the face of the can where the other aluminum band 1 is applied. The aluminum band 1 is a composition strip which comprises separation means 11. These separation means 11 are intended to be positioned on the contact areas of two adjacent cans 2. In the FIG. 2, the covered contact areas correspond to a part of the perimeters of the horizontal sides of the cans 2 which are in contact with each other. In particular, the contact area is localized at the level of a sidewall of the cans in contact.

The cans 2 also can be positioned in adjacent arrangements, or horizontal stack, as shown in FIG. 3, in which the cans 2 are aligned in a straight line and a part of the vertical sides 22 of the cans 2 are in contact. These cans are held together by two aluminum bands 1 positioned on either side of these neighboring cans. As illustrated in this figure, the cans can have a different shape, and in particular cylindrical shape.

The packaging system accommodates a variety of can structures and weights, including, but not limited to, rounded can of varying diameter and height and cubic can of varying dimensions.

The cans can be metal cans, plastic cans or a combination of these.

Connections Between Cans

Structure of the Aluminum Band

According to a first embodiment, the aluminum band is in the form of a longitudinal strip, as shown in FIG. 2 and FIGS. 4 to 7. Specifically, the aluminum band is intended to extend longitudinally along the overlying cans, and has a shape of a narrow strip.

In FIGS. 4 to 7, the aluminum band is designed to cover cans having a rectangular shape and which are aligned so that two neighboring cans have their horizontal sides in contact. These cans are assembled by a longitudinal aluminum band 1 so as to form a vertical stack.

In FIG. 4, the aluminum band is intended to assemble three cans. The aluminum band has an overall length of 103 mm and an overall width of 35 mm. A delimitation is represented and made 1.5 mm from the edge of the aluminum band, so as to form identification areas 23. In the embodiment shown, the identification areas 23 have a rectangular shape, which can accommodate a 2 or 3 dimensional deep embossing tack label. Preferably, the identification areas 23 located at the ends of the aluminum band has a length of 32 mm and a width of 28 mm while the identification areas which include two other identification areas on either side have a length of 32 mm and a width of 31 mm. Each of the delimited identification areas is thus positioned above a can. In this way, the rectangles of two neighboring cans are spaced apart by a space of 6.5 mm.

Such dimensions can be adapted to the dimensions of barcodes or QR codes usually used or imposed in different countries. In the same way, the dimensions of the aluminum band can be adapted so as to correctly bind a plurality of cans.

In the embodiment shown, each duo of two neighboring cans 2 has a contact area in which the vertical sides of the cans are in contact. At this contact area, the aluminum band which overlaps and connects the cans has a perforation zone 10. In other words, the perforation zone 10 of the aluminum band is superimposed on the contact areas of the two neighboring cans 2 located below the aluminum band 1.

The perforation zone 10 comprises separation mean or cutting mean. In particular, each separation means 11 has two lines of notches 111. The lines of notches 11 are separated from another by a distance corresponding to the portion of sidewall of cans covered by said aluminum band. The lines of notches, in the FIG. 4, are preferentially spaced 3.5 mm apart.

Each of the lines of notches 11 includes a plurality of notches 1111. The lines of notches are separated by a separation portion 12. The separation portion 12 comprises longitudinal sides corresponding to the lines of notches, and lateral sides 121 connecting the lines of notches. In the embodiments represented, the lateral sides 121 have a V-shape. In preferred modes, the lateral sides are in the form of "U" or "V," or alike. In other words, the lateral sides can have a straight, rounded, or segmented shape. As shown, the point of the "V" or the "U" of the lateral sides is directed towards the interior of the separation portion.

A person skilled in the art will easily imagine other embodiments in which one or more lines of notches may be provided at the perforation zone.

According to a second embodiment, the packaging is in the form of a longitudinal aluminum band which assembles a plurality of adjacent and cylindrical cans, as shown in FIG. 3. These aluminum bands comprise separation means identical to those described for the previous embodiment.

Composition of the Packaging/Aluminum Bond

The aluminum band extends longitudinally along the superimposed boxes, and makes it possible to connect the cans with respect to each other, or in other words to assemble the cans into a multipack of cans, as shown in FIG. 7.

To enable this, the aluminum band includes a combination of aluminum and adhesive, more precisely an Aluminum/PE complex. In particular, the aluminum band comprises an adhesive inner layer and an aluminum outer layer. Preferably, the outer aluminum layer and the inner adhesive layer has a total thickness between 50 μm and 200 μm, preferably 70 μm. This total thickness may or may not include a liner or backing-paper.

The adhesive elements can also vary such as polymer, metal, paper or combination of those.

The complex Aluminum/PE complex can be treated with a lacquer during printing.

The aluminum band can be recycled in the metal recycling stream. The sticker is strong enough to hold the pack and permits the practical detachment of individual cans.

The disclosure substrate is designed for creating 2 and 3 dimensional deep embossing aluminum bands, enabling very fine printed details such as QR codes and EAN barcodes.

Production Method

Initially, to make a packaging can multipack, i.e., a pack of cans assembled by an aluminum band are usually arranged in a straight row so that, in their stacked and orientated position (i.e., horizontally or vertically oriented), they can be transferred to a conveyor heading towards and through the labelers. This conveyor can be equipped with an additional top conveyor that provides stability to the stack of cans as it passes through the labelling applicator.

To apply the adhesive laminated strip to a stack of cans, the inner adhesive layer side must be directed against the cans, so that the separating portions overlap the sidewall portions of the neighboring cans. The degree of bond is influenced by the amount of pressure used to apply the adhesive strip to the surface of the cans.

Once the aluminum band is correctly positioned, sufficient pressure is applied for the inner layer of the band to adhere to the cans, for example by one or several 100 mm diameter soft rollers. The rollers are mounted on either side of the conveyor downstream of the label applicator. They should be designed not to splay or move when the multipack passes through them to ensure equal pressure is applied to the full length of the laminated strip.

This binding strength allows the aluminum band to have the strength it needs to hold the cans together in transit and on the shopper's journey. It also has the benefit that the multipack is easy to open in a rotational motion by applying a torque value of less than 3 Nm.

It is also possible to use an onboard printer which will print the label before it is applied to the superposed cans.

Use

It is easy to detach one or more cans from the multipack of cans. To do this, the consumer must perform a rotary movement by grasping the can that he wants to detach. This force must be exerted on one or more cans located on one end of the pack.

FIG. 7 illustrates an example in which three cans 2 are aligned and connected by an aluminum band 1, before and after separation of one of the cans 2. The upper end can 2 could be separated from the multipack 1 by a simple rotation. In particular, the aluminum band, under the influence of the rotational force, is cut at one of the lines of notches 111. The aluminum band 1 is then cut into two separate parts which remain attached to their respective cans 2.

In other embodiment, comprising a horizontal stack as shown in FIG. 3, the cans are separated with ease by tearing the perforation down vertically. More precisely, the terms "pulled vertically" means that the consumer exerts a force in a direction substantially perpendicular to the direction of alignment of the cans. This force can be achieved by the fingers, in particular by pulling two parts of the aluminum band in the opposite sides, on either side of the lines of perforations. It is also possible to separate the cans by pulling vertically on the separation portion located between the two lines of perforations. It is also possible to separate the cans by pulling vertically on the separation portion located between the two lines of perforations, i.e., by pulling in a direction substantially perpendicular to the direction of alignment of the cans.

The advantages of the aluminum band over other patent applications and existing products on the market is that it has the strength and durability to hold a heavier cans grocery weight more than 500 g and a lightness to be simply twisted open by hand.

The cans can be released in a twist type movement. In particular, the cans can be released by applying a rotational force with a torque value between 2 Nm and 3 Nm.

The aluminum band according to the disclosure offers the possibility of having a packaging can multipack system in which once the first can is removed the unused cans remain neatly stacked together and can still be moved and transported easily.

The aluminum band has notches built into the packaging design where two cans meet, to support the ease of separating the cans by rotating or twisting them, and allows easy separation of cans by all age groups. The notches are made just inside the edge of the aluminum band to give that additional binding strength.

VARIATIONS

Variations include a single band that wraps around all cans, multiple bands that may be applied on either side of the stack of cans. Bands may also vary in dimension (length and width) depending on application and can format.

It is also possible to provide a pack of cans held by one or a plurality of aluminum bands. The aluminum bands of the same pack can be identical or different, that is to say comprising different dimensions or a different number of separation means.

The aluminum bands can be positioned on the same face, on opposite faces or adjacent faces of the cans.

In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An aluminum band for covering or wrapping at least partially a stack of substantially identical cans, said aluminum band being a composite strip comprising separation means configured to be positioned on a contact area of two adjacent cans of said stack, the aluminum band comprising:

the separation means are torsion cutting means comprising two lines of notches on opposite sides of a separation portion of the aluminum band configured to cover said contact area, the separation portion including lateral sides having a V shape or a U shape between the two lines of notches;

the aluminum band comprises an inner adhesive layer and an outer metal layer of aluminum or aluminum alloy foil; and an entirety of the aluminum band is in contact with the stack.

2. The aluminum band according to claim 1, wherein said inner adhesive layer of the aluminum band is chosen among polymers, metals and paper.

3. The aluminum band according to claim 1, wherein said inner adhesive layer of the aluminum band includes polyethylene.

4. The aluminum band according to claim 1, wherein the aluminum band comprises a 2 or 3 dimensional embossed tack label.

5. The aluminum band according to claim 4, wherein said tack label comprises QR codes or EAN barcodes.

6. A packaging can multipack system comprising an arrangement of cans and a least one aluminum band according to claim 1 covering or wrapping at least partially said arrangement of cans.

7. The packaging can multipack system according to claim 6, wherein said packaging can multipack system comprises one single aluminum band wrapping around all cans together being arranged either in a vertical or a horizontal stack.

8. The packaging can multipack system according to claim 6, wherein said packaging can multipack system comprises a plurality of aluminum bands applied on either side of the stack of cans.

9. The packaging can multipack system according to claim 6, wherein said packaging can multipack system comprises two aluminum bands applied on two opposite sides of a vertical stack of cans.

10. A method for manufacturing a packaging can multipack system, comprising:

forming a stack of cans by aligning a plurality of substantially identical cans in a common direction;

applying at least one aluminum band to the stack having two lines of notches on opposite sides of a separation portion of the aluminum band, including superimposing the separation portion between sidewalls of adjacent cans in the stack; and applying pressure to the at least one aluminum band.

11. The method of claim 10, wherein applying pressure to the at least one aluminum band includes forming the separation portion into a V shape or a U shape at lateral sides of the separation portion between the two lines of notches.

12. An aluminum band, comprising:

a composite strip of material configured to cover or wrap around at least a portion of a stack of cans, the composite strip of material including a separation portion configured to be aligned at an interface between adjacent cans in the stack, the separation portion including lateral sides, wherein the composite strip of material includes two lines of notches with one line of notches on either side of the separation portion, wherein the lateral sides of the separation portion are recessed at the interface, wherein an entirety of the composite strip of material is adhered to the stack of cans, and wherein the composite strip of material is configured to separate at one of the lines of notches in response to a rotational force applied by a user.

13. The aluminum band of claim 12, wherein the composite strip of material includes only two lines of notches.

14. The aluminum band of claim 12, wherein the composite strip of material is a laminated tape comprising an inner adhesive layer and an outer metal layer.

15. The aluminum band of claim 14, wherein the inner adhesive layer is on an entirety of the composite strip of material and comprises low density polyethylene.

16. The aluminum band of claim 15, wherein the outer metal layer is aluminum or aluminum alloy foil.

17. The aluminum band of claim 12, wherein the rotational force has a torque value between 2-3 Newton-meters.

* * * * *